US005232211A

United States Patent [19]

Kubota et al.

[11] Patent Number: 5,232,211

[45] Date of Patent: Aug. 3, 1993

[54] SHEET TRANSPORT DEVICE CAPABLE OF PREVENTING MULTIPLE FEEDING

[75] Inventors: Hiroshi Kubota, Osaka; Kenji Oda, Toyonaka, both of Japan

[73] Assignee: Mita Industrial Co., Ltd., Osaka, Japan

[21] Appl. No.: 896,246

[22] Filed: Jun. 10, 1992

[30] Foreign Application Priority Data

Jun. 18, 1991 [JP] Japan ..... 3-145894

[51] Int. Cl.[5] ..... B65H 3/44

[52] U.S. Cl. ..... 271/9; 271/122

[58] Field of Search ..... 271/9, 121, 122, 125

[56] References Cited

U.S. PATENT DOCUMENTS

| | | | |
|---|---|---|---|
| 4,060,232 | 11/1977 | Gibson . | |
| 4,733,310 | 3/1988 | Kapp et al. . | |
| 4,966,358 | 10/1990 | Yokoi et al. | 271/9 |
| 5,065,995 | 11/1991 | Iwamoto et al. | 271/9 |
| 5,076,563 | 12/1991 | Namba et al. | 271/122 |

FOREIGN PATENT DOCUMENTS

| | | | |
|---|---|---|---|
| 2442205 | 11/1978 | France . | |
| 223739 | 11/1985 | Japan | 271/9 |
| 1452127 | 10/1976 | United Kingdom . | |
| 2180013 | 3/1987 | United Kingdom . | |
| 2230763 | 10/1990 | United Kingdom . | |

*Primary Examiner*—Robert P. Olszewski
*Assistant Examiner*—Steven M. Reiss
*Attorney, Agent, or Firm*—Jordan and Hamburg

[57] ABSTRACT

A sheet transport device includes a first cassette which holds first conventional thin, wide sheets; a first sheet separator positioned along a first transport path in order to separate the first sheets from one another, and including a first forward roller rotated in the sheet transport direction, a first parallel retard roller rotatable in an opposite direction, and a drive mechanism which transmits the driving force to the first retard roller only when the first forward roller and the first retard roller are out of contact with each other, such that otherwise, the first retard roller moves together with the first forward roller when they are in contact with each other, the first forward roller and first retard roller being held out of contact with each other when a first sheet is placed therebetween; a second cassette which holds the first sheets or second thicker, narrow sheets which does not permit the first forward roller and the first retard roller to contact each other when placed therebetween; and a second sheet separator positioned along a second transport path in order to separate the second sheets from one another, the second sheet separator including a second forward roller which is rotated in the sheet transport direction and a second retard roller which is rotatable in the opposite direction and which is spaced apart from the second forward roller by a distance at least equal to the first thickness during activation of the second sheet separator.

8 Claims, 8 Drawing Sheets

SHEET TRANSPORT DEVICE CAPABLE OF PREVENTING MULTIPLE FEEDING

BACKGROUND OF THE INVENTION AND RELATED ART STATEMENT

This invention relates to a sheet transport device for use in a printer, copying machine or like image forming apparatus.

There has been known a sheet transport device provided with feed rollers 3, 4 for dispensing sheets one by one from cassettes 1, 2 containing the sheets therein and a sheet separator 5 including a forward roller 18 which rotates in a direction along transport of a sheet and a retard roller 21 rotatable in a direction against the transport of the sheet as shown in FIG. 8. The retard roller 21 is mounted on a drive shaft which is biased toward the forward roller 18 by a spring or other biasing member, and accordingly is held in contact with the forward roller 18. Further, a torque limiter is mounted to the drive shaft of the retard roller 21 so as to control transmission of torque from a driving source to the drive shaft of the retard roller 21. The torque limiter is designed to cause the retard roller 21 to idly rotate upon receipt of the torque greater than a specified value.

The driving force of the forward roller 18 is set greater than that of the retard roller 21. In a normal sheet transport operation, the driving force of the transport roller 18 is transmitted to the retard roller 21 directly or through the sheet held between the rollers 18 and 21, activating the torque limiter to cause the retard roller 21 to idly rotate. Thereby, the retard roller 21 is caused to rotate in the sheet transport direction together with the forward roller 18 to transport the sheet.

In the case where a plurality of sheets are transported to a nip between the rollers 18 and 21 with one sheet adhered to another, i.e. in case of multiple feeding, the sheets come into sliding contact with one another, preventing transmission of the driving force of the forward roller 18 to the retard roller 21. This causes the retard roller 21 to rotate in a direction opposite to the rotating direction of the forward roller 18 and thereby the sheet in contact with the forward roller 18 and the one in contact with the retard roller 21 are subjected respectively to a transporting force and a retarding force working in opposing directions and separated from each other. As a result, transport of the sheet in contact of the retard roller 21 can be deterred.

The forward and retard rollers 18 and 21 are usually arranged as shown in FIGS. 9 and 10. With reference to FIG. 9, the forward roller 18 includes a long roller member while the retard roller 21 including a plurality of short roller members arranged at specified spacings along an axis. The number of roller members and the spacing between two adjacent roller members of the retard roller 21 are determined based on the width of copy sheets standardized for use in an image forming apparatus (hereafter referred to as standardized copy sheets). With this arrangement of the roller members of the retard roller 21, the following problems arise in the case where special sheets having the small width are to be transported. The special sheet may be material made of sheet, such as an envelope. Let it be assumed that special sheets A are being transported in line in a sheet transport device provided with a retard roller 21 including two roller members spaced along a drive shaft of the roller 21 as shown in FIG. 9. In this case, the roller members of the retard roller 21 unavoidably come into contact with the forward roller 18 at outer sides thereof. If only a portion of the retard roller 21 is in contact with the forward roller 18 when the sheet is separated, the driving force of the roller 18 is transmitted to the roller 21 and thereby the torque limiter causes the roller 21 to idly rotate. This will result in unsatisfactory sheet separation. In other words, since friction drag working on the contact portion of the rollers 18 and 21 is exceedingly large, the torque limiter disengages from the drive shaft of the roller 21 which in turn rotates together with the roller 18 in the sheet transport direction. Accordingly, in the case where two special sheets A are transported with the one sheet adhered to the other, i.e. in case of double feeding, the two special sheets A cannot be subjected to the transporting and retarding forces and therefore cannot be separated from each other properly.

The sheet transport device may be provided with a retard roller 21 having a single roller member as shown in FIG. 10 so as to properly separate special sheets A fed in line as described above. This sheet transport device suffers the disadvantage that, when the two special sheets A are transported side by side at one time, a center portion of the roller 21 comes into contact with the forward roller 18 and therefore the special sheets A cannot be separated properly.

In view of the above, a requirement is that the retard roller is not in contact with the forward roller when the special sheets having the small width such as envelopes are separated. Accordingly, it is preferable that the forward and retard rollers be away from each other in a normal state. However, since the standardized copy sheets which are most frequent in use are generally thin, it is preferable to keep the forward and retard rollers in contact with one another in the normal state in order to transport the standardized copy sheets reliably. On the contrary, the special sheets such as envelopes are generally thicker than the standardized copy sheets.

SUMMARY OF THE INVENTION

In view of the foregoing problems, it is an object of the present invention to provide a sheet transport device which has a simple construction and is capable of effectively separating sheets being transported even in the case where sheets having the large thickness and small width such as envelopes are fed in line or side by side.

Accordingly, a sheet transport device of the invention comprises first cassette means for containing therein first sheets having a small thickness and various sizes, first transport path means along which the first sheets dispensed from the first cassette means are transported, first sheet separator means disposed in a specified position along the first transport path means for separating the sheets from one another, the first sheet separator means including a first forward roller which is rotated in a direction along transport of the sheets, a first retard roller which is disposed in parallel to the first forward roller and rotatable in a direction against the transport of the sheets, a shaft on which the first retard roller is mounted and a drive mechanism for transmitting the driving force to the first retard roller, the first forward roller and first retard roller being held in contact with each other, second cassette means for containing therein either the first sheets or second sheets having a thickness larger than that of the first sheet and various sizes, second transport path means along which the sheets dispensed from the second cassette means are transported, and second sheet separator means disposed in a specified position along the second transport path means for separating the sheets from one another, the second sheet separator means including a second forward roller which is rotated in the direction along the transport of the sheets and a second retard roller which is rotatable in the direction against the transport of the sheets and is spaced away from the second forward roller by a distance corresponding to the thickness of the special sheets.

With the sheet transport device thus constructed, the first sheets having the small thickness dispensed from the first or second cassette means are fed to the nip between the forward and retard rollers in the first sheet separator means, whereby the first sheets are separated from one another in case of multiple feeding. Also the second sheets having the large thickness dispensed from the second cassette means are separated in case of multiple feeding while passing through a space defined by the second transport and second retard rollers.

The second cassette means may be provided more upstream than the first cassette means with respect to the sheet transport direction, and the first transport path means may extend from a downstream end of the second transport path means.

With this arrangement, the first or second sheets dispensed from the second cassette means are fed to the first sheet separator means disposed along the first transport path means through the second sheet separator means disposed along the second transport path means. The first sheets are separated while transported through the first sheet separator means while the second sheets are separated while passing through the second sheet separator means if a plurality of sheets are fed at one time. On the contrary, the first sheets dispensed from the first cassette means are directly fed to the first sheet separator means in which the first sheets are separated while being transported if a plurality of first sheets are fed at one time.

Further, the first retard roller may include a plurality of short roller members, and an installation distance defined by outer ends of the most outwardly arranged roller members along an extending direction of the shaft may be set smaller than the width of a smallest first sheet to be dispensed from the first cassette means.

With this arrangement, when the first sheet dispensed from the first cassette means is fed to the first sheet separator means, the first forward and retard rollers are completely separated from each other by the presence of the first sheet held therebetween. Accordingly, improper sheet separation can be prevented which results from the fact that the end portions of these rollers come into contact with each other during a sheet separating operation.

Moreover, the distance between the second forward roller and second retard roller may be set slightly smaller than the thickness of the second sheets and greater than that of the first sheets.

With this arragement, upon the second sheets dispensed from the second cassette means reaching the second sheet separator means, proper separating forces are given to the second sheets by the second transport and second retard rollers in case of multiple feeding. Also, upon reaching the second sheet separator means, the first sheets dispensed from the second cassette means smoothly pass through the space defined by the second transport and second retard rollers. Accordingly, there can be prevented application of unnecessary separating forces to the first sheets by these rollers.

The sheet transport device may further comprise clutch means for intermittently shutting off transmission of the driving force from the drive mechanism to the first retard roller, detector means for detecting feed of the second sheet from the second cassette means, and control means, in response to the detector means, for controllably bringing the clutch means into a disengaged state when the detector means detects the feed of the second sheet from the second cassette means.

With the sheet transport device thus constructed, when the second sheet is dispensed from the second cassette means, the clutch means is brought into the disengaged state to shut off transmission of the driving force be applied to the first retard roller. Accordingly, the second sheet transported to the first sheet separator means passes therethrough smoothly without being subjected to unnecessary separating forces. When the first sheet is dispensed from the second cassette means, the clutch means is kept in an engaged state to transmit the driving force to the first retard roller. Accordingly, the first sheet is properly separated in the first sheet separator means if necessary.

Further, the second transport path means may be so formed as to bypass the first sheet separator.

With this arrangement, the second sheet dispensed from the second cassette means is transported along the second transport path means formed and curved at a great curvature, bypassing the first sheet separator. Accordingly, the second sheet is less likely to be bent while being transported.

Moremover, the first cassette means for containing the first sheets may be provided more upstream than the second cassette means exclusively for containing the second sheets with respect to the sheet transport direction, and the second transport path means may extend from a downstream end of the first transport path means.

With this arrangement, the first sheets dispensed from the first cassette means are separated, if necessary, in the first sheet separator means provided along the first transport path means, and introduced to the second sheet separator provided along the second transport path means. The first sheets are further transported after passing loosely through the space defined between the second forward roller and the second retard roller. The second sheet dispensed from the second cassette is fed to the second sheet separator means and transported therethrough while being separated if necessary.

These and other objects, features and advantages of the present invention will become more apparent upon a reading of the following detailed description and accompying drawings.

DETAILED DESCRIPTION OF PREFERRED EMBODIMENTS OF THE INVENTION

Figure 1:
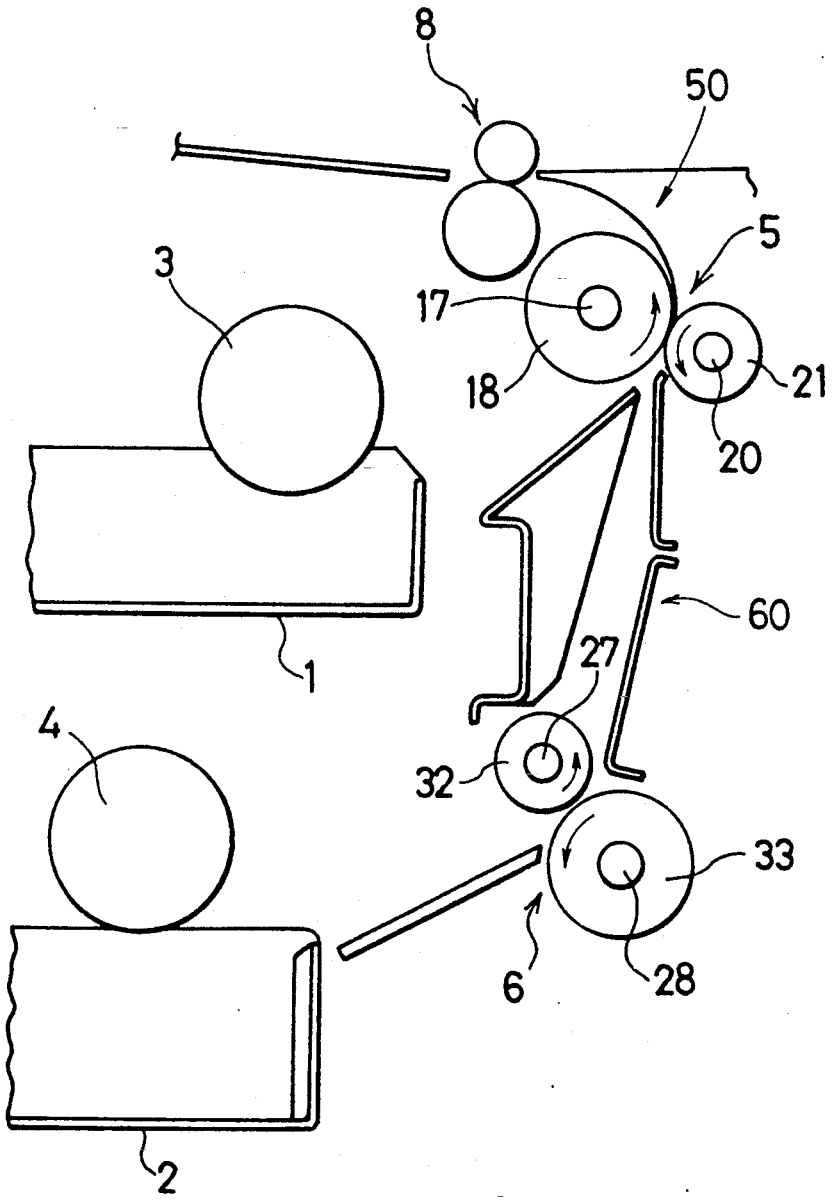
FIG. 1 is a diagram schematically showing an embodiment of a sheet transport device in accordance with the invention.
Figure 2:
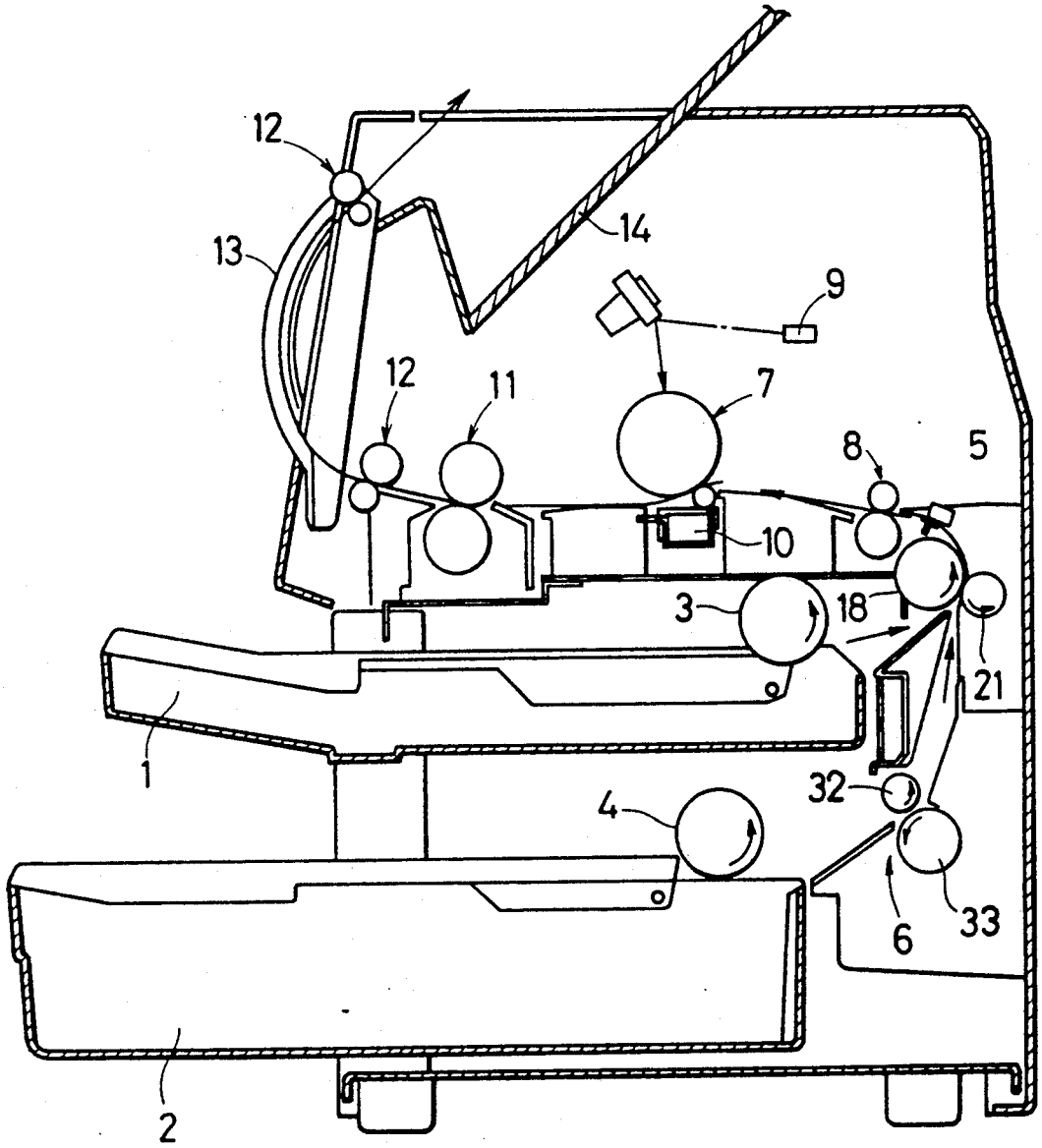
FIG. 2 is a diagram schematically showing an entire construction of an image forming apparatus incorporating the sheet transport device.

FIGS. 1 and 2 show an exemplary image forming apparatus incorporating a sheet transport device in accordance with the invention. The image forming apparatus is provided with first and second cassettes 1 and 2 each for containing copy sheets of specified sizes therein, feed rollers 3 and 4 at respective portions of the cassettes 1 and 2 from which copy sheets are dispensed, first sheet separator 5, second sheet separator 6 and a pair of registration rollers 8. The first sheet separator 5 is disposed in a specified position along a first transport path 50 along which the copy sheet dispensed from the first cassette 1 is transported. The second sheet separator 6 is disposed in a specified position along a second transport path 60 along which the copy sheet dispensed from the second cassette 2 is transported. The registration roller pair 8 are adapted for feeding the sheet to an imaging assembly including a photosensitive drum 7 at a specified timing.

The surface of the drum 7, after charged by an unillustrated charger, is illuminated by laser beams projected from a laser 9, whereby an electrostatic latent image is formed thereon. Around the drum 7 are arranged an unillustrated developing device for developing the latent image into a toner image and a transfer device for transferring the toner image onto a copy sheet transported thereto. The copy sheet is transported from the imaging assembly to a fixing assembly including a pair of fixing rollers 11 in which the transferred image is fixed onto the copy sheet, and then discharged to a discharge tray 14 by way of a pair of discharge rollers 12 and a discharge guide 13.

In the first cassette 1 provided in a middle portion of the image forming apparatus are contained standardized copy sheets having the normal thickness of about 0.1 mm. The second cassette 2 below the first cassette 1 is designed to contain both the standardized copy sheets and special sheets having the thickness greater than that of the standardized copy sheets. The thickness of the special sheets is about 0.25 to 0.4 mm. The type of the sheets to be contained in the second cassette 2 is selected according to needs.

The first sheet separator 5 disposed in the first transport path 50 is rotatably mounted to a frame 15 of the image forming apparatus. In addition, the first sheet separator 5 is provided with a drive shaft 17, forward roller 18 mounted on the drive shaft 17, another drive shaft 20, and a pair of retard rollers 21 mounted on the drive shaft 20 and spaced away from each other. The drive shaft 17 is drivingly rotated in a direction of transport of the sheet by a drive gear 16. Further, the drive shaft 20 is drivingly rotated in a direction opposite to the sheet transport direction by a drive gear 19.

Figure 4:
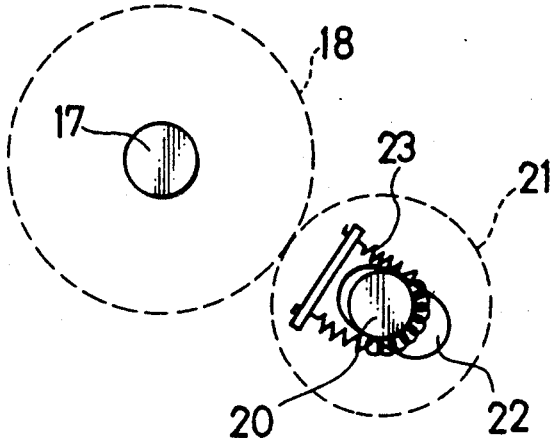
FIG. 4 is a side view showing the first sheet separator.

The drive shaft 20 of the retard rollers 21 is mounted to a support portion including a slot 22 which is defined in the frame 15 and is extending in a direction parallel to a line connecting centers of the drive shafts 17 and 20 as shown in FIG. 4. Accordingly, the drive shaft 20 is supported slidably along the slot 22. The drive shaft 20 is biased toward the drive shaft 17 of the forward roller 18 by a biasing member including a helical spring 23, and thereby the retard rollers 21 are held in pressing contact with the forward roller 18. Further, a torque limiter 24 is attached to the drive gear 19 mounted on the drive shaft 20 of the retard rollers 21. The torque limiter 24 is disengaged from the drive shaft 20 upon receipt of a torque of a predetermined or greater level, thereby shutting off transmission of the driving force from the drive gear 19 to the drive shaft 20.

Figure 3:
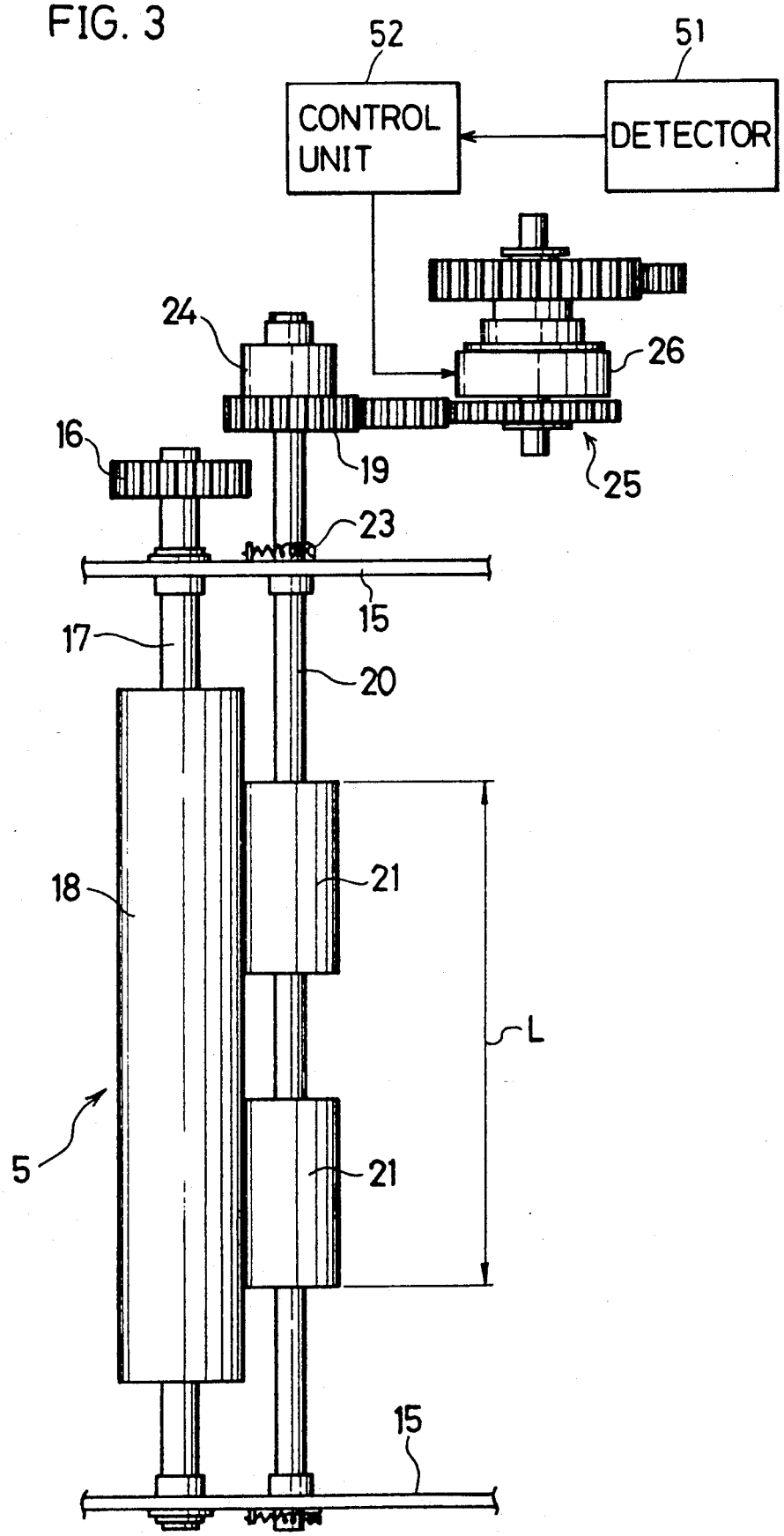
FIG. 3 is a plan view showing a construction of a first sheet separator.

An installation distance L defined by the separating rollers 21, 21 as shown in FIG. 3 is set smaller than the width of the smallest standardized copy sheet to be transported. Further, an electromagnetic clutch 26 is provided in a drive mechanism 25 including a gear mechanism for transmitting the driving force to the drive gear 19. The clutch 26 engages and disengages to intermittently shut off transmission of the driving force to the drive gear 19. A detector 51 is disposed in the vicinity of the second cassette 2 to detect the feed of the special sheet from the cassette 2 and sends a sensor signal to a control unit 52. In the case where it is confirmed that the special sheet has been fed from the second cassette 2 in accordance with the sensor signal, the control unit 52 sends a control signal to the electromagnetic clutch 26 so as to bring the clutch 26 into a disengaged state. In other cases, the clutch 26 is maintained in an engaged state.

Figure 5:
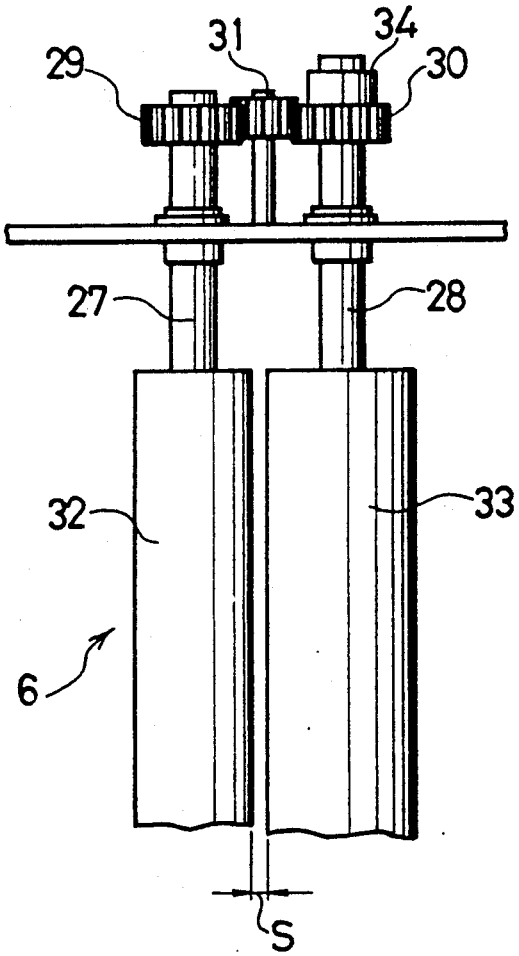
FIG. 5 is a plan view showing a construction of a second sheet separator.

The second sheet separator 6 disposed in the second transport path 60 is mounted to the frame 15 as shown in FIG. 5. The second sheet separator 6 is provided with drive shafts 27 and 28, drive gears 29 and 30 respectively for drivingly rotating the drive shafts 27 and 28, intermediate gear 31, forward roller 32 mounted on the drive shaft 27 and retard roller 33 mounted on the drive shaft 28. The intermediate gear 31 is provided between the gears 29 and 30 for transmitting the driving force from the gear 29 to the gear 30 while reversing the direction of the driving force. The forward and retard rollers 32 and 33 are spaced away from each other by a distance S which is smaller than the thickness of the special sheets and greater than that of the standardized copy sheets.

To the drive gear 30 mounted to the drive shaft 28 of the retard roller 33 is attached a torque limiter 34. The torque limiter 34 disengages from the drive shaft 28 upon receipt of a torque of a predetermined or greater level, thereby shutting off transmission of the driving force from the gear 30 to the shaft 28.

With the image forming apparatus thus constructed, when a plurality of standardized copy sheets are fed at one time from the first cassette 1, these sheets are separated in the first sheet separator 5 as follows. The plurality of standardized copy sheets are transported from the cassette 1 to the nip between the forward and retard rollers 18 and 21 in the first sheet separator 5. In the first separator 5, a forwarding force is given to the face of the sheet in contact with the roller 18 while a retarding force working in a direction opposite to the forwarding force is given to the face of the sheet in contact with the roller 21. In this way, the sheets in contact with the roller 21 are successively subjected to the retarding force and thereby multiple feeding can be prevented. Hereinafter, the forwarding and retarding forces are referred to as separating forces. More specifically, in the case where two standardized copy sheets are fed at one time from the first cassette 1, the sheet in contact with the roller 18 is subjected to the forwarding force from the roller 18 to be transported to the imaging assembly while the sheet in contact with the roller 21 is subjected to the retarding force from the roller 21. Accordingly, the two sheets are separated from each other, and transport of only one sheet is proceeded while that of the other is prevented.

In the case where the standardized copy sheets are properly fed one by one from the first cassette 1, the driving force of the forward roller 18 is transmitted to the retard rollers 21 through the sheet held therebetween. Since the driving force of the roller 18 is set greater than the driving force of the roller 21, the torque limiter 24 is brought into the disengaged state upon receipt of the driving force of the roller 18. This causes the roller 21 to idly rotate together with the roller 18 in the sheet transport direction. Therefore, the sheet can be smoothly transported to the imaging assembly since the transport thereof is not interfered by the roller 21.

When a plurality of special sheets are fed at one time from the second cassette 2, these sheets are separated in the second sheet separator 6 as follows. The plurality of special sheets from the cassette 2 are transported between the forward and retard rollers 32 and 33 in the second sheet separator 6. In the second separator 6, the separating forces are given to the face of the sheet in contact with the roller 32 and that in contact with the roller 33, thereby preventing multiple feeding. As a result, one special sheet is introduced to the first sheet separator 5 located above in a proper state. The special sheet introduced to the first separator 5 is transported to the imaging assembly while being held between the forward and retard rollers 18 and 21.

More specifically, when the special sheet is introduced to the first separator 5, the drive shaft 20 of the retard rollers 21 is pushed by the special sheet. The drive shaft 20 slides along the slot 22 formed in the frame 15 away from the drive shaft 17 of the forward roller 18 and thereby the distance corresponding to the thickness of the introduced special paper is defined between the rollers 18 and 21. Further, the electromagnetic clutch 26 is brought into the disengaged state in accordance with the control signal from the control unit 52, shutting off transmission of the driving force to the drive shaft 20 of the rollers 21. Accordingly, the special sheet passes through the first sheet separator 5 and is transported to the imaging assembly smoothly without being subjected to unnecessary separating forces on front and rear faces thereof.

Also, in the case where standardized copy sheets are contained in the second cassette 2, the sheets dispensed from the cassette 2 pass loosely between the forward and retard rollers 32 and 33 in the second sheet separator 6 and are fed to the first sheet separator 5. This is because the distance S defined between the rollers 32 and 33 is set greater than the thickness of the standardized copy sheets. Proper separating forces are given to the standardized copy sheets by the forward and retard rollers 18 and 21 in the case where a plurality of sheets are fed to the first sheet separator 5 at one time, and thereby multiple feeding can be prevented.

In this way, the first sheet separator 5 for separating the standardized copy sheets having the normal thickness is disposed in the first transport path 50 and the second sheet separator 6 for separating the special sheets having the large thickness is disposed in the second transport path 60. With this arrangement, the standardized copy sheets can be properly separated to prevent the multiple feeding thereof in the first sheet separator 5. In addition, the special sheets can be transported to the first sheet separator 5 after being properly separated in the second sheet separator 6.

More specifically, since the forward and retard rollers 18 and 21 constituting the first sheet separator 5 are arranged in contact with each other, the standardized copy sheets fed between the rollers 18 and 21 can be separated when subjected to the proper separating forces in case of multiple feeding. The multiple feeding can be effectively prevented by setting a drag torque of the torque limiter 24 attached to the drive gear 19 of the retard rollers 21 to a value at which the standardized copy sheets can be properly separated from one another.

Further, the forward and retard rollers 32 and 33 constituting the second sheet separator 6 are spaced away from each other by the distance S corresponding to the thickness of the special sheets. Accordingly, the rollers 32 and 33 in no way come into contact with each other in the case where the special sheets such as envelopes are transported in line or side by side, thereby reliably preventing an occurrence of improper sheet separation due to disengagement of the torque limiter 34 from the drive shaft 28.

Moreover, the distance S between the forward and retard rollers 32 and 33 is set slightly smaller than the thickness of the special sheets and larger than that of the standardized copy sheets. Accordingly, it can be prevented that the excessively large loads be given to the front and rear faces of the special sheets. In addition, the multiple feeding can be effectively prevented by properly separating the special sheets transported to the second sheet separator 6 if necessary. Further, in the case where the standardized copy sheets are contained in the second cassette 2, the sheets fed to the second sheet separator 6 pass loosely through the space defined between the forward and retard rollers 32 and 33. This can prevent the likelihood that the unnecessary separating forces are given to the standardized copy sheets from the rollers 32 and 33.

Also, in the case where the installation distance L defined by the retard rollers 21 of the first sheet separator 5 is set smaller than the width of the smallest standardized copy sheets to be dispensed from the first or second cassette 1 or 2, the forward and retard rollers 18 and 21 are completely separated from each other by the presence of the standardized copy sheet fed to the first sheet separator 5. Accordingly, there can be reliably prevented improper sheet separation due to an undesirable contact of, for example, side end portions of the rollers 18 and 21.

Further, in the case where the feed of the special sheet from the second cassette 2 is confirmed in accordance with the sensor signal from the detector 51, the electromagnetic clutch 26 is brought into the disengaged state in response to the control signal sent from the control unit 52. This arrangement is made for the purpose of shutting off transmission of the driving force of the drive mechanism 25 to the retard roller 21 in the first sheet separator 5. With this arrangement, it can be prevented that the retarding force is given to the special sheet in the first sheet separator 5. Therefore, the special sheet can be transported smoothly without being damaged.

Figure 6:
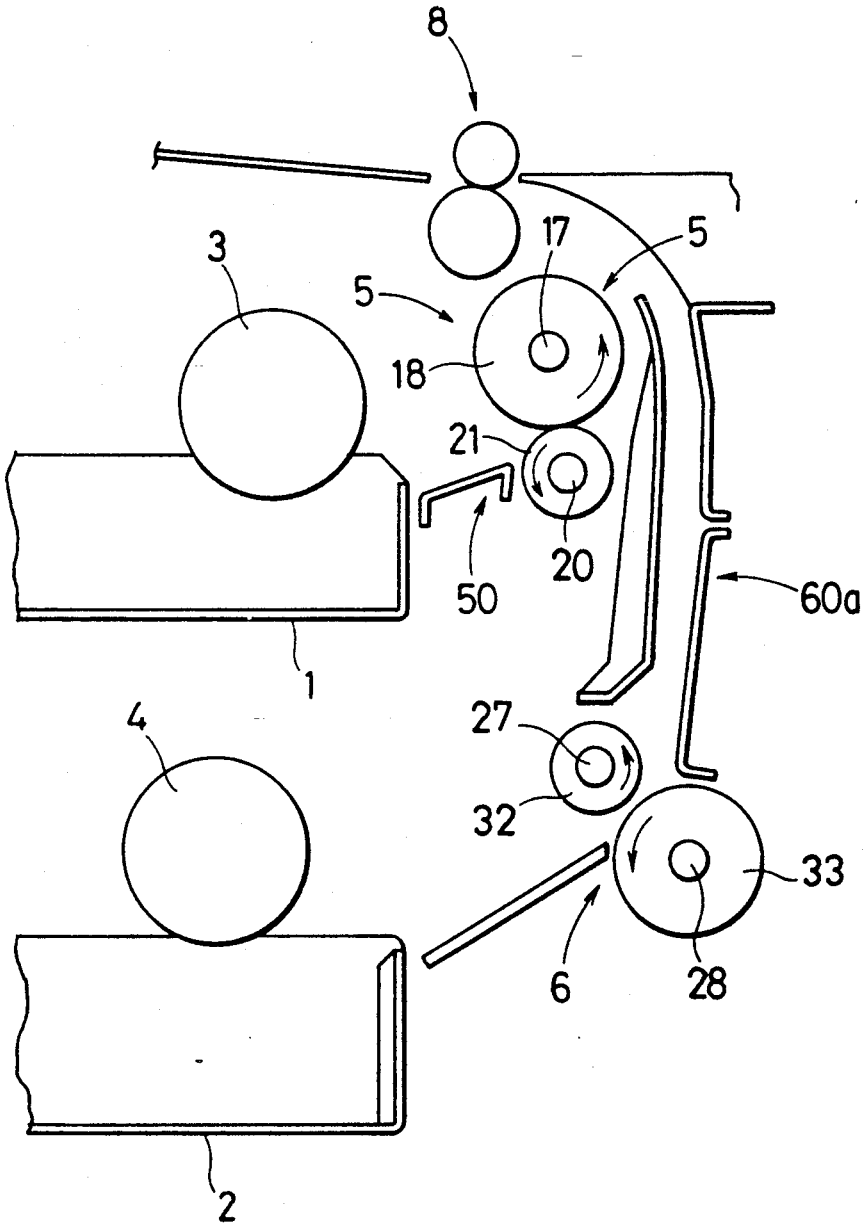
FIG. 6 is a diagram showing another sheet transport device including a second transport path bypassing a first sheet separator.

Furthermore, in the case where the second cassette 2 disposed below the first cassette 1 is exclusively used for special sheets, it is not necessarily required to feed the sheet dispensed from the cassette 2 to the first sheet separator 5. It may be appropriate to provide a second transport path 60*a* bypassing the first sheet separator 5 as shown in FIG. 6. The special sheet may be transported to an unillustrated imaging assembly along the second transport path 60*a*. In this case, there can be obviated the need for a construction shutting off transmission of the driving force from the driving gear 19 to the retard roller 21 in the first sheet separator 5 when the special sheet is transported to the imaging assembly. Accordingly, the electromagnetic clutch 26 and other related components may be dispensed with. Provision of the second transport path 60*a* may also enjoy the following advantage. The second transport path 60*a* can be formed and curved at a greater curvature compared to the other second transport path 60. The special sheets such as envelopes are thick and stiff in comparison with standardized copy sheets. In view of this, the second transport path 60*a* curved at the greater curvature is advantageous because the thick and stiff special sheet can be smoothly transported without being excessively bent.

Figure 7:
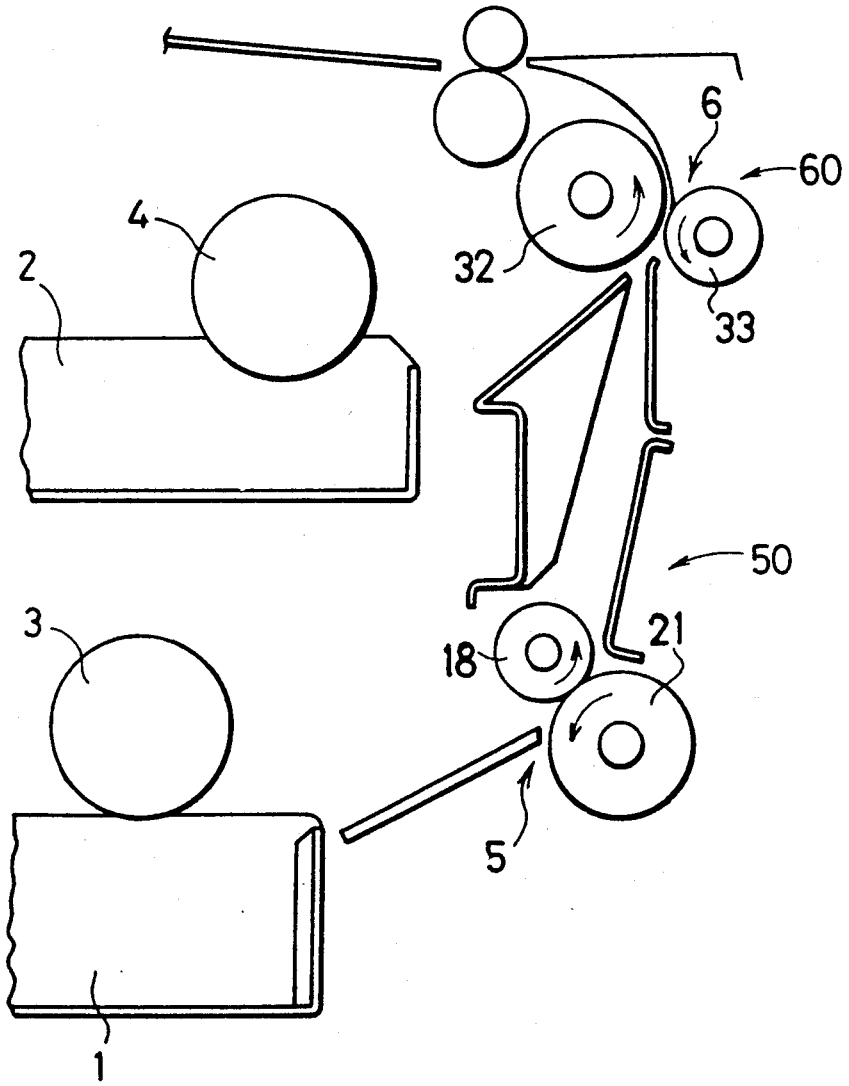
FIG. 7 is a diagram showing still another sheet transport device.
Figure 8:
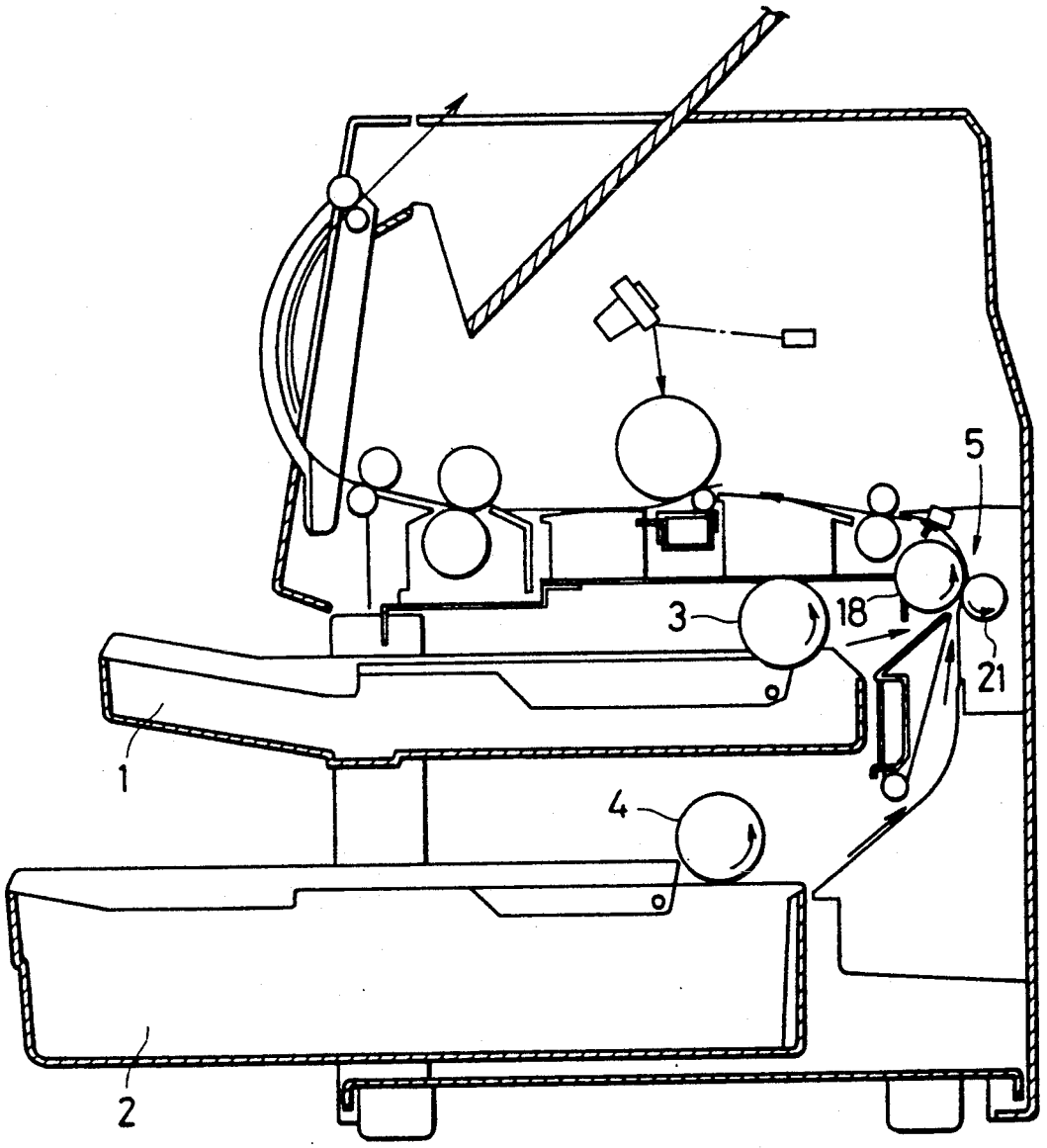
FIG. 8 PRIOR ART
FIG. 8 is a diagram schematically showing an image forming apparatus incorporating a sheet transport device of prior art.
Figure 9:
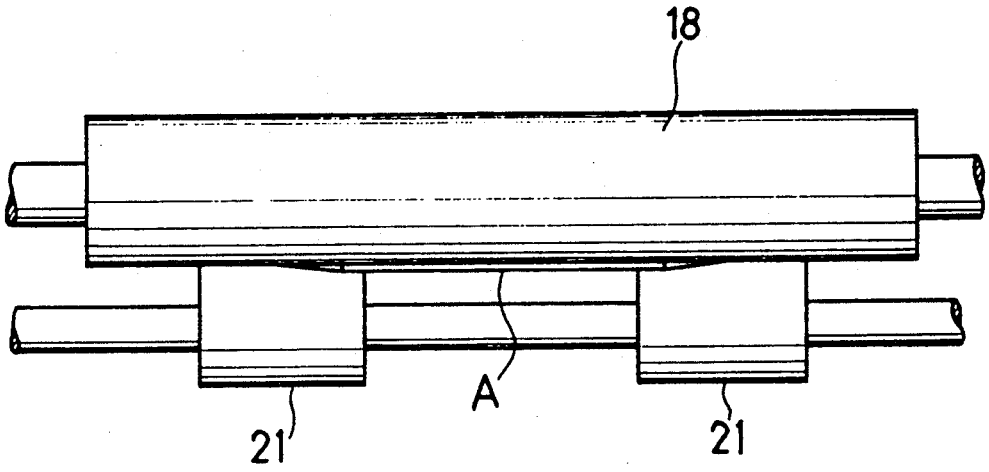
FIG. 9 PRIOR ART
FIG. 9 is a diagram showing a construction of a sheet separator of prior art.
Figure 10:
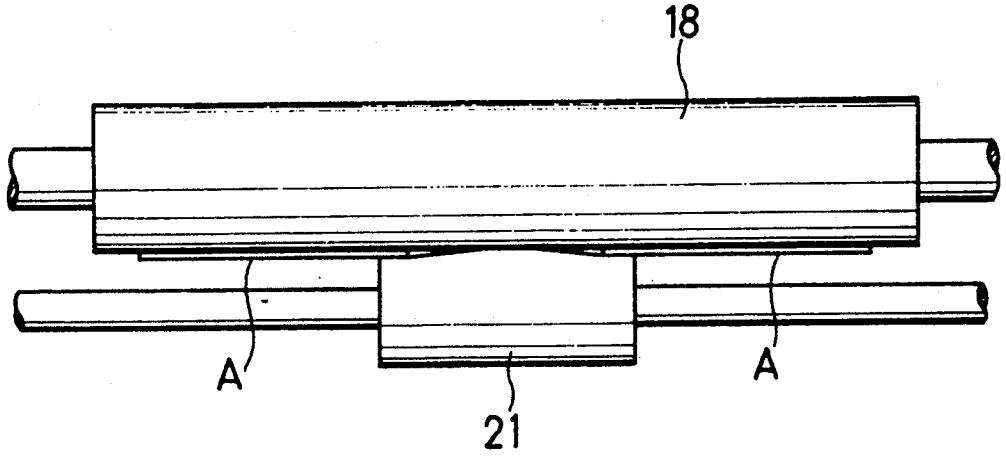
FIG. 10 PRIOR ART
FIG. 10 is a diagram showing another construction of a sheet separator of prior art.

In addition, as shown in FIG. 7, the first cassette 1 containing the standardized copy sheets having the normal thickness may be disposed below the second cassette 2 containing the special sheets, i.e. upstream of the cassette 2 with respect to the sheet transport direction. In this case, the second transport path 60 extends from a downstream end of the first transport path 50. Also, the second sheet separator 6 including the forward roller 32 and retard roller 33 spaced away from each other at a specified distance is disposed along the second transport path 60, and the first sheet separator 5 including the forward roller 18 and retard rollers 21 in contact with each other is disposed along the first transport path 50. The standardized copy sheets dispensed from the cassette 2 are properly separated in the first sheet separator 5 in case of multiple feeding and transported to the imaging assembly after passing loosely between the rollers 32 and 33. The special sheets dispensed from the second cassette 2 are properly separated in the second sheet separator 6 when a plurality of those are fed to the separator 6 at one time, thereby preventing the multiple feeding. In this case, the sheet from the second cassette 2 is not fed to the first sheet separator 5.

As described above, in accordance with the invention, standardized copy sheets having the normal thickness are fed to a nip between forward and retard rollers in contact with each other in a first sheet separator, so that only one standardized copy sheet is transported to an imaging assembly. Further, special sheets having the large thickness are fed between forward and retard rollers spaced away from each other at a specified distance in a second sheet separator, so that only one special sheet is transported to the imaging assembly. Accordingly, the invention enjoys the advantages that multiple feeding of standardized copy sheets and special sheets can be prevented effectively respectively by proper sheet separation offered in the first and second sheet separators, and that damage to the special sheets can be prevented.

The forward and retard rollers in the second sheet separator are disposed spaced away from each other at the specified distance corresponding to the thickness of the special sheets. This arrangement prevents these rollers from coming into contact with each other at any portions thereof in the case where the special sheets such as envelopes are transported in line or side by side. Accordingly, the special sheet can be properly transported regardless of whether these sheets are fed in line or side by side by setting a spacing between retard rollers in the first sheet separator suitably for a manner in which these sheets are fed.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A sheet transport device comprising:

first cassette means for containing therein first sheets having a first thickness and a first width;

first transport path means along which first sheets are fed from the first cassette means by a first feeder provided near the first cassette means;

first sheet separator means disposed in a specified position along the first transport path means for separating the first sheets from one another, the first sheet separator means including:

a first forward roller which is rotated in a direction of sheet transport, a first retard roller which is disposed in parallel to the first forward roller and rotatable in a direction against the sheet transport direction, when said first retard roller is supplied with a driving force, and a drive mechanism for:

transmitting the driving force to the first retard roller when the first forward roller and the first retard roller are not in contact with each other and transmitting no driving force to the first retard roller when the first forward roller and the first retard roller are in contact with each other in order to allow the first retard roller to move together with the first forward roller, the first forward roller and first retard roller being held in driving contact with each other when a first sheet is placed between the first forward roller and the first retard roller;

second cassette means for containing therein either the first sheets or second sheets having a second thickness larger than the first thickness and a second width which do not permit the first forward roller and the first retard roller to contact each other when a second sheet is placed therebetween;

second transport path means along which sheets are fed from the second cassette means by a second feeder provided near the second cassette means; and second sheet separator means disposed in a specified position along the second transport path means for separating the second sheets from one another, the second sheet separator means including a second forward roller which is rotated in the sheet transport direction and a second retard roller which is rotatable in a direction against the sheet transport direction and spaced apart from the second forward roller by a distance at least equal to the first thickness during activation of said second sheet separator means .

2. A sheet transport device according to claim 1 wherein the second cassette means is provided more upstream than the first cassette means with respect to the sheet transport direction, and the second transport path means joins the first transport path means.

3. A sheet transport device according to claim 2 wherein the second cassette means exclusively contains the second sheets therein and the second transport path means is so formed as to bypass the first sheet separator means.

4. A sheet transport device according to claim 1 wherein the distance between the second forward roller and second retard roller is set slightly smaller than the second thickness.

5. A sheet transport device according to claim 1 wherein the first retard roller includes a plurality of roller members arranged along an axis, and a distance defined by outer ends of the most outwardly arranged roller members along the axis is set smaller than the first width.

6. A sheet transport device according to claim 1 wherein the second sheets are envelopes.

7. A sheet transport device according to claim 1 wherein the first cassette means is provided more upstream than the second cassette means with respect to the sheet transport direction, and the first transport path means joins the second transport path means.

8. A sheet transport device comprising:

first cassette means for containing therein first sheets having a small thickness and various sizes;

first transport path means along which the first sheets dispensed from the first cassette means are transported;

first sheet separator means disposed in a specified position along the first transport path means for separating the first sheets from one another, the first sheet separator means including a first forward roller which is rotated in a sheet transport direction, a first retard roller which is disposed in parallel to the first forward roller and rotatable in a direction against the sheet transport direction when said first retard roller is supplied with a driving force, a drive mechanism for transmitting the driving force to the first retard roller, the first forward roller and first retard roller being held in contact with each other;

second cassette means for containing therein either the first sheets or second sheets having a thickness larger than that of the first sheets and various sizes, the second cassette means being provided more upstream than the first cassette means with respect to the sheet transport direction;

second transport path means along which the sheets dispensed from the second cassette means are transported, such that the first transport path means extends from a downstream end of the second transport path means;

second sheet separator means disposed in a specified position along the second transport path means for separating the second sheets from one another, the second sheet separator means including a second forward roller which is rotated in the sheet transport direction and a second retard roller which is rotatable in a direction against the sheet transport direction and spaced away from the second forward roller by a distance corresponding to the thickness of the first sheet;

clutch means for intermittently shutting off transmission of the driving force from the drive mechanism to the first retard roller;

detector means for detecting feed of a second sheet from the second cassette means; and control means, in response to the detector means, for controllably bringing the clutch means into a disengaged state when the detector means detects the feed of the second sheet from the second cassette means.

* * * * *